US010830013B2

(12) United States Patent
Drenth et al.

(10) Patent No.: US 10,830,013 B2
(45) **Date of Patent: *Nov. 10, 2020**

(54) CORE BARREL HEAD ASSEMBLY WITH AN INTEGRATED SAMPLE ORIENTATION TOOL AND SYSTEM FOR USING SAME

(71) Applicants: LONGYEAR TM, INC., Salt Lake City, UT (US); GLOBALTECH CORPORATION PTY LTD

(72) Inventors: Christopher L. Drenth, Burlington (CA); Gordon Stewart, Claremont (AU); Khaled Hejleh, Peppermint Grove (AU)

(73) Assignees: LONGYEAR TM, INC., Salt Lake City, UT (US); GLOBALTECH CORPORATION PTY LTD, Canning (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/588,026

(22) Filed: Sep. 30, 2019

(65) Prior Publication Data

US 2020/0024921 A1 Jan. 23, 2020

Related U.S. Application Data

(63) Continuation of application No. 16/017,334, filed on Jun. 25, 2018, now Pat. No. 10,465,463, which is a (Continued)

(51) Int. Cl.
*E21B 25/16* (2006.01)

(52) U.S. Cl.
CPC ..... *E21B 25/16* (2013.01)

(58) Field of Classification Search
CPC ..... E21B 25/16
See application file for complete search history.

(56) References Cited

U.S. PATENT DOCUMENTS 2,944,792 A 7/1960 Gros
4,955,438 A 9/1990 Juergens et al.
(Continued)

FOREIGN PATENT DOCUMENTS

AU 2015249889 4/2015
AU 2019257536 4/2015
(Continued)

OTHER PUBLICATIONS

International Search Report and Written Opinion were dated Jul. 24, 2015 by the International Searching Authority for International Application No. PCT/US2015/026907, filed on Apr. 21, 2015 and published as WO 2015/164394 on Oct. 29, 2015 (Applicant—Longyear TM, Inc.) (11 Pages).
(Continued)

*Primary Examiner* — Michael R Wills, III
(74) *Attorney, Agent, or Firm* — Ballard Spahr LLP

(57) ABSTRACT

A core barrel head assembly having at least one electronic instrument that is configured to obtain orientation data; a power source; and a communication means to receive and/or transmit orientation data for use in a core sample down hole surveying and sample orientation system that is configured to provide an indication of the orientation of a core sample relative to a body of material from which the core has been extracted, and also to a method of core sample orientation identification.

25 Claims, 12 Drawing Sheets

Related U.S. Application Data continuation of application No. 14/692,484, filed on Apr. 21, 2015, now Pat. No. 10,047,581.

(60) Provisional application No. 61/982,052, filed on Apr. 21, 2014.

(56) References Cited

U.S. PATENT DOCUMENTS

| | | | |
|---|---|---|---|
| 5,601,152 | A | 2/1997 | Harrison |
| 6,732,818 | B2 | 5/2004 | Gregory |
| 7,296,638 | B2 | 11/2007 | Beach et al. |
| 10,047,581 | B2 | 8/2018 | Drenth et al. |
| 10,465,463 | B2 | 11/2019 | Drenth et al. |
| 2012/0145461 | A1 | 6/2012 | Cravatte |
| 2015/0300162 | A1 | 10/2015 | Drenth et al. |
| 2018/0305995 | A1 | 10/2018 | Drenth et al. |

FOREIGN PATENT DOCUMENTS

| | | | |
|---|---|---|---|
| AU | 2015249889 | B2 | 8/2019 |
| BR | 112016024554.7 | | 4/2015 |
| CA | 2946574 | | 4/2015 |
| CL | 2016-002684 | | 4/2015 |
| CN | 101649727 | A | 2/2010 |
| CN | 201396092 | Y | 2/2010 |
| CN | 2015800211077 | | 4/2015 |
| EP | 2134921 | A1 | 12/2009 |
| EP | 15782230.5 | | 4/2015 |
| EP | 19188334.7 | | 4/2015 |
| EP | 3134600 | | 3/2017 |
| GB | 2243173 | A | 10/1991 |
| PE | 2111-2016 | | 4/2015 |
| WO | WO-2006/024111 | | 3/2006 |
| WO | WO-2007/104103 | A1 | 9/2007 |
| WO | WO-2007/137356 | | 12/2007 |
| WO | WO-2008/113127 | A1 | 9/2008 |
| WO | WO-2010/094060 | | 8/2010 |
| WO | WO-2013/040641 | | 3/2013 |
| WO | WO-2013/126955 | | 9/2013 |
| WO | WO-2014/053012 | A1 | 4/2014 |
| WO | WO-2014/089618 | | 6/2014 |
| WO | PCT/US2015/026907 | | 4/2015 |
| WO | WO-2015/164394 | A1 | 10/2015 |
| ZA | 2016/07259 | | 4/2015 |

OTHER PUBLICATIONS

International Preliminary Report on Patentability was dated Oct. 25, 2016 by the International Searching Authority for International Application No. PCT/US2015/026907, filed on Apr. 21, 2015 and published as WO 2015/164394 on Oct. 29, 2015 (Applicant—Longyear TM, Inc.) (9 Pages).

Third Party Observations dated Aug. 17, 2016 for International Patent Application No. PCT/US2015/026907 (Applicant—Longyear Tm, Inc.) (42 pages).

Examination Report was dated Aug. 14, 2018 by the Australian Patent Office for AU Application No. 2015249889, which was filed on Apr. 21, 2015 (Applicant—Longyear TM, Inc.) (3 pages).

Notice of Acceptance was dated Jul. 23, 2019 by the Australian Patent Office for AU Application No. 2015249889, which was filed on Apr. 21, 2015 (Applicant—Longyear TM, Inc.) (3 pages).

Office Action was dated Jul. 11, 2018 by the Chilean Patent Office for CL Application No. 2016-002684, which was filed on Apr. 21, 2015 (Applicant—Longyear TM, Inc.) (3 pages).

First Office Action was dated Sep. 10, 2018 by the SIPO for CN Application No. 2015800211077, filed on Apr. 21, 2015 and published CN 107109899 as Aug. 29, 2017 on (Applicant—Longyear TM, Inc.) (5 Pages).

Second Office Action was dated Jan. 19, 2020 by the SIPO for CN Application No. 2015800211077, filed on Apr. 21, 2015 and published CN 107109899 as Aug. 29, 2017 on (Applicant—Longyear TM, Inc.) (6 Pages).

Extended European Search Report dated Oct. 17, 2017 by the European Patent Office for Application No. 15782230.5, which was filed on Apr. 21, 2015 and published as EP 3134600 on Mar. 1, 2017 (Inventor—Drenth et al.; Applicant—Longyear TM, Inc.) (9 pages).

Preliminary Amendment was dated Feb. 28, 2017 to the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (7 pages).

Non Final Rejection was dated Aug. 18, 2017 by the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (7 pages).

Response to Non Final Rejection was dated Oct. 18, 2017 to the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (9 pages).

Notice of Allowance was dated Nov. 8, 2017 by the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (5 pages).

Notice of Allowance was dated Apr. 12, 2018 by the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (7 pages).

Issue Notification was dated Jul. 25, 2018 by the USPTO for U.S. Appl. No. 14/692,484, filed Apr. 21, 2015 and now U.S. Pat. No. 10,047,581 on Aug. 14, 2018 (Inventor—Drenth et al.; Applicant—Longyear TM, Inc.) (1 page).

Non Final Rejection was dated Mar. 14, 2019 by the USPTO for U.S. Appl. No. 16/017,334, filed Jun. 25, 2018 and now U.S. Pat. No. 10,465,463 on Nov. 5, 2019 (Inventor—Christopher L. Drenth) (11 Pages).

Response Non Final Rejection was dated Jun. 12, 2019 to the USPTO for U.S. Appl. No. 16/017,334, filed Jun. 25, 2018 and now U.S. Pat. No. 10,465,463 on Nov. 5, 2019 (Inventor—Christopher L. Drenth) (9 Pages).

Notice of Allowance was Dated Mar. 14, 2019 by the USPTO for U.S. Appl. No. 16/017,334, filed Jun. 25, 2018 and now U.S. Pat. No. 10,465,463 on Nov. 5, 2019 (Inventor—Christopher L. Drenth) (5 Pages).

Issue Notification was dated Mar. 14, 2019 by the USPTO for U.S. Appl. No. 16/017,334, filed Jun. 25, 2018 and now U.S. Pat. No. 10,465,463 on Nov. 5, 2019 (Inventor—Christopher L. Drenth) (1 Page).

U.S. Appl. No. 61/982,052, filed Apr. 21, 2014, Christopher L. Drenth.

U.S. Appl. No. 14/692,484 (U.S. Pat. No. 10,047,581), filed Apr. 21, 2015 (Aug. 14, 2018), Christopher L. Drenth.

U.S. Appl. No. 16/017,334 (U.S. Pat. No. 10,465,463), filed Jun. 25, 2018 (Nov. 5, 2019), Christopher L. Drenth.

"Devicore BBT Directional Core Drilling Borehole Planning Service" Retrieved from the Internet:URL:http://www.devico.com/products/devicore-bbt [stored on the Wayback Machine on Feb. 14, 2014].

CORE BARREL HEAD ASSEMBLY WITH AN INTEGRATED SAMPLE ORIENTATION TOOL AND SYSTEM FOR USING SAME

CROSS REFERENCE TO RELATED PATENT APPLICATION

This application is a continuation of U.S. application Ser. No. 16/017,334, filed Jun. 25, 2018, which is a continuation of U.S. patent application Ser. No. 14/692,484, filed on Apr. 21, 2015, which is now U.S. Pat. No. 10,047,581, issued Aug. 14, 2018, which claims priority to U.S. Provisional Application No. 61/982,052, filed on Apr. 21, 2014. Each of these applications is incorporated herein by reference in its entirety.

FIELD OF THE INVENTION

The present invention relates to down hole surveying in drilling operations. More particularly, to a core barrel assembly having at least one electronic instrument that is configured for use in a core sample down hole surveying and sample orientation system. In one example, the at least one electronic instrument is configured to provide an indication of the orientation of a core sample relative to a body of material from which the core has been extracted, and also to a method of core sample orientation identification.

BACKGROUND

Conventionally, core samples are obtained through the use of core drilling systems that comprise outer and inner tube assemblies. In operation, a cutting head is attached to the outer tube assembly so that rotational torque applied to the outer tube assembly can be transmitted to the cutting head. A core is generated during the drilling operation, with the core progressively extending along the elongate axis of the inner tube assembly as drilling progresses. Typically, when a core sample is acquired, the core within the inner tube assembly is fractured and the inner tube assembly and the fractured core sample contained therein are then retrieved from within the drill hole, typically by way of a retrieval cable lowered down the drill hole. Once the inner tube assembly has been brought to ground surface, the core sample can be removed and subjected to the desired analysis.

It is desirable for analysis purposes to have an indication of the orientation of the core sample relative to the ground from which it was extracted. This is complicated in that it is common to drill at an angle relative to the vertical. For efficiency and accuracy of the mineralogical record, it is desirable to determine the orientation and survey position of each core's position underground before being drilled out and extracted. Such orientation and survey positions allow for the subsequent production of a three dimensional map of underground mineral/rock content.

One common way of obtaining an indication of the orientation of a core sample is through use of an orientation spear comprising a marker (such as a crayon) projecting from one end of a thin steel shank, the other end of which is attached to a wire line. The orientation spear is lowered down the drill hole, prior to the inner tube assembly being introduced. The marker on the orientation spear strikes the facing surface of material from which the core is to be generated, leaving a mark thereon. Because of gravity, the mark is on the lower side of the drill hole. The inner tube assembly is then introduced into the outer tube assembly in the drill hole. As drilling proceeds, a core sample is generated within the inner tube assembly. The core sample so generated carries the mark which was previously applied. Upon completion of the core drilling run and retrieval of the core sample, the mark provides an indication of the orientation of the core sample at the time it was in the ground.

Other conventional technologies use core orientation units attached to core inner tubes and back-end assemblies to determine the correct orientation of the drilled out core sample after a preferred predetermined drilling distance intervals during drilling. These core orientation units typically measure rotational direction of the core sample before extraction. On retrieval at the surface of the hole, the rotational direction can be determined by electronic means and the upper or lower side of the core material physically 'marked' for later identification by geologists.

Coupled with the core orientation system, a survey instrument is conventionally used. In this technique, at periodic depths, the survey instrument is lowered down the drill hole to determine azimuth (angular measurement relative to a reference point or direction), dip (or inclination) and any other required survey parameters. These periodic depth survey readings are used to approximate the drill-path at different depths. Together with the rotational position of the extracted core (from the core orientation device), the three dimensional subsurface material content map can be determined.

It has been found desirable to provide an improved core barrel assembly having an integrated sample orientation subassembly and method for using same that is configured for use in a core sample down hole surveying and sample orientation that minimizes the need to add additional drill string elements, which allows for increased efficiency and speed of drilling.

SUMMARY

In one aspect, the present invention provides a core barrel head assembly having an elongate tube body that defines a selectively sealed interior cavity. The core barrel head assembly can have at least one electronic instrument positioned in the interior cavity that is configured to obtain core orientation data of a core sample and a power source positioned in the interior cavity and in electrical communication with the at least one electronic instrument. The core barrel head assembly can also have a communication means that is configured to receive and/or transmit orientation data for use in a core sample down hole surveying and/or sample orientation system. The derived core orientation data provides an indication of the orientation of the core sample relative to a body of material from which the core has been extracted, and also to a method of using same.

The core barrel head assembly is configured for connection to tube portions of a drill string via respective connection means. In another aspect, the at least one electronic instrument of the core barrel head assembly can be mounted, for example and without limitation, within the interior cavity defined the body, within an interior cavity that is defined therein a side wall of the body of the core barrel head assembly, or potted or in sealed contact with a portion of a side wall of the core barrel assembly (on either an exterior surface or an interior surface of a cavity defined therein the body). As one skilled in the art will contemplate, the core barrel head assembly can comprise at least one electronic instrument that is configured to obtain orientation data, an electrically coupled power source and communication means to receive and/or transmit orientation data.

In another aspect, the communication means can comprise a wireless communication means that is configured to wirelessly receive and/or transmit survey data. Optionally, the communication means can be configured to communicate one way or two ways with each other, when drilling has ceased or during drilling.

In one aspect, the at least one electronic instrument of the core barrel head assembly advantageously enables obtaining drill hole survey readings without the need to insert unwieldy extension drill rods and/or a survey probe to measure azimuth and inclination/dip of the drill hole path. This results in a reduction of equipment handling and usage of equipment, a reduction of operations by not needing to periodically withdraw the drill bit a certain distance in order to advance a survey probe ahead of, and therefore distanced from, the drill bit, with a resultant increase in operational efficiency.

Another aspect of the present invention provides a method of conducting a down hole survey of drilling, the method including: a) drilling the core from a subsurface body of material; b) recording data relating to orientation of the core to be retrieved, the data recorded using the at least one electronic instrument of the core barrel head assembly, c) separating the core from the subsurface body, and d) obtaining an indication of the orientation of the core based on the recorded core orientation data obtained before the core was separated from the subsurface body.

Optionally, the method can comprise: determining that drilling has ceased for a period of time, using the at least one electronic instrument of the core barrel head assembly to record data relating to orientation of the core to be retrieved, separating the core from the subsurface body, retrieving the core to the surface, and obtaining an indication of the orientation of the core based on the recorded core orientation data obtained once the drilling had ceased and before the core was separated from the subsurface body.

Advantages are that there is more time available for drilling due to less time required for surveying and manipulating additional pieces of equipment and mechanical extensions during the survey process.

DETAILED DESCRIPTION

Figure 1:
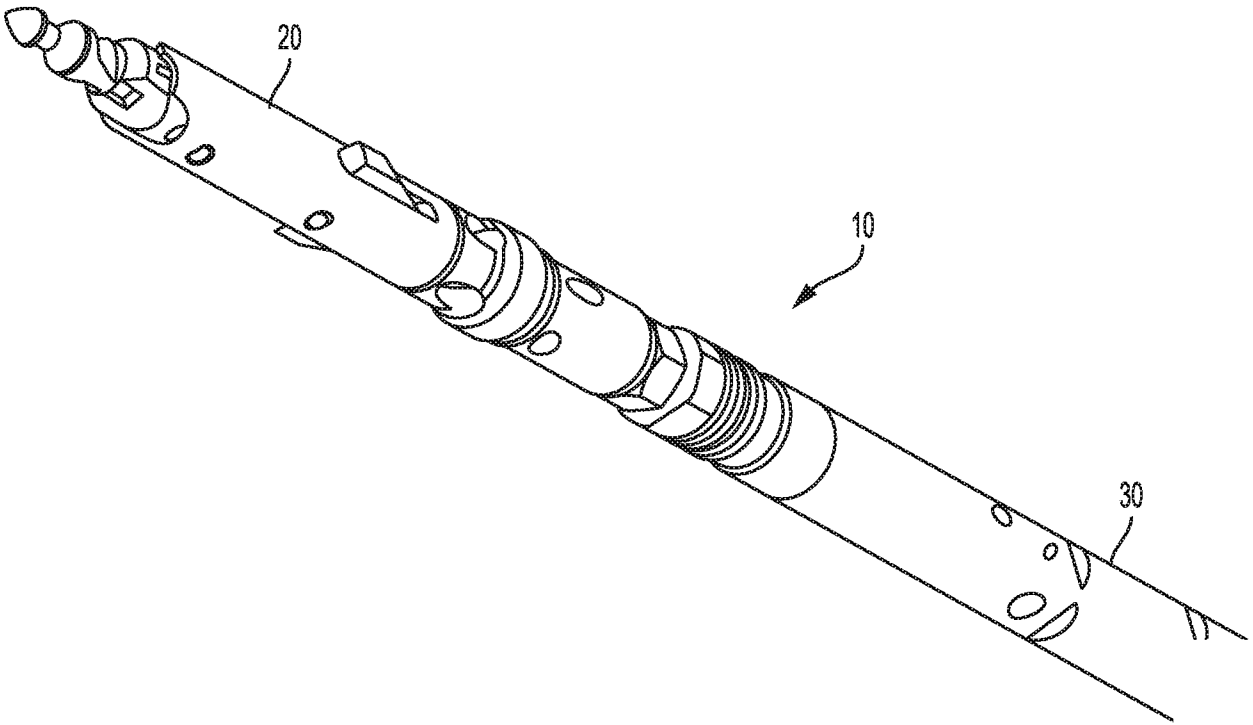
FIG. 1 shows a perspective view of a core barrel head assembly being operatively coupled to a head assembly.
Figure 2:
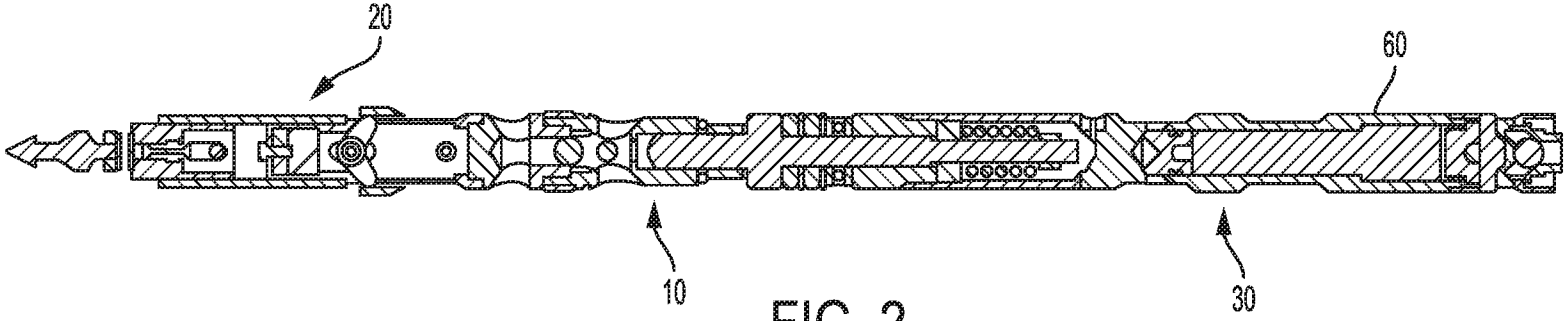
FIG. 2 shows a longitudinal cross-sectional view of FIG. 1.
Figure 3:
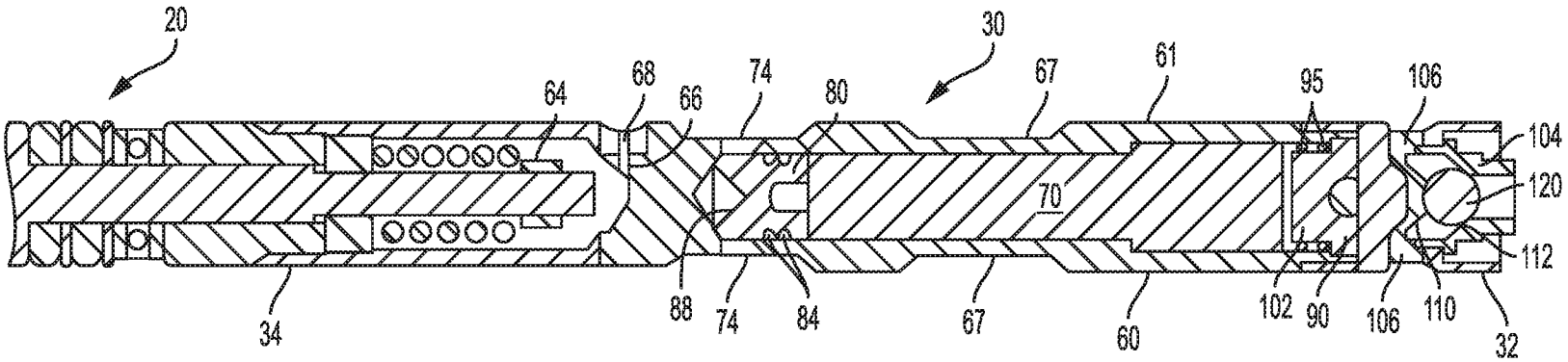
FIG. 3 shows an expanded view of a portion of FIG. 2, showing the core barrel head assembly.
Figure 4:
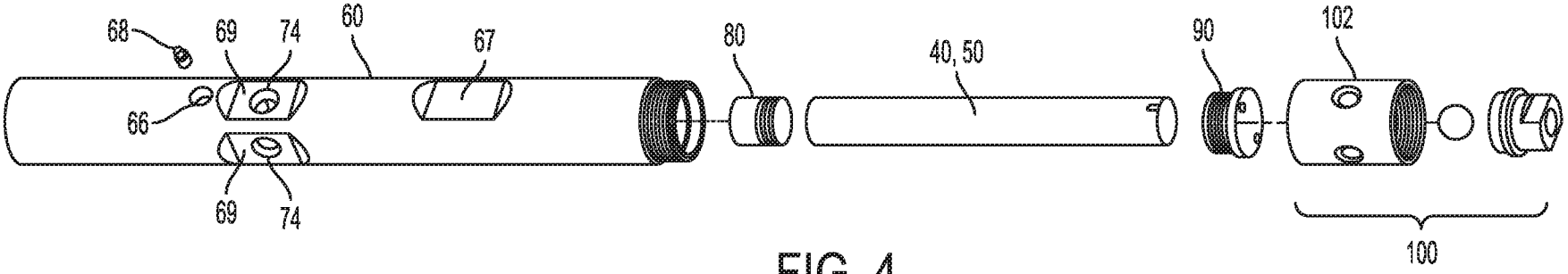
FIG. 4 shows a perspective exploded view of the core barrel head assembly of FIG. 1.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a port" can include two or more such ports unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As will be appreciated by one skilled in the art, the methods and systems may take the form of an entirely hardware embodiment, an entirely software embodiment, or an embodiment combining software and hardware aspects. Furthermore, the methods and systems may take the form of a computer program product on a computer-readable storage medium having computer-readable program instructions (e.g., computer software) embodied in the storage medium. More particularly, the present methods and systems may take the form of web-implemented computer software. Any suitable computer-readable storage medium may be utilized including, without limitation, hard disks, CD-ROMs, optical storage devices, magnetic storage devices, or solid-state electronic storage devices.

Embodiments of the methods and systems are described below with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

In one aspect, a drill assembly for drilling into a subsurface body of material can comprise a drill string 10 comprising a drill bit, an outer tube formed of linearly connected tube sections, and an inner tube for receiving the core drilled from the subsurface body. In one aspect, the core barrel head assembly 30 is integrated into the drill string 10 to form a portion of the drill string, such as shown in FIG. 1, where the core barrel head assembly is operably coupled to a conventional head assembly 20.

The core barrel head assembly is configured for connection to tube portions of a drill string via respective connection means. In another aspect, the at least one electronic instrument of the core barrel head assembly can be mounted, for example and without limitation, within the interior cavity defined the body, within an interior cavity that is defined therein a side wall of the body of the core barrel head assembly, or potted or in sealed contact with a portion of a side wall of the core barrel assembly (on either an exterior surface or an interior surface of a cavity defined therein the body). As one skilled in the art will contemplate, the core barrel head assembly can comprise at least one electronic instrument that is configured to obtain orientation data, an electrically coupled power source and communication means to receive and/or transmit orientation data.

In one aspect, and referring to FIGS. 1-7, the core barrel head assembly 30 can comprise at least one electronic instrument 40 that is configured to obtain orientation data, a operatively electrically coupled power source 50 and communication means to receive and/or transmit orientation data. In one aspect, at least one electronic instrument 40 can comprise at least one digital and/or electro-mechanical sensors 42, and/or one or more physical data sensors 44 in a core orientation data recording tool that can be configured to determine the core orientation just prior to or after the core break, and, optionally, to detect the signal of the break of the core from the body of material. In various aspects, it is contemplated that the recorded data can optionally include "dip" angle and/or azimuth datum to increase the reliability of the core orientation results as described below.

In this aspect, the at least one digital and/or electro-mechanical sensor 42 in operative communication with the at least one electronic instrument 40 of the core barrel assembly can be configured to detect vibration and/or to detect tri-axial gravitation loading acting on the electronic instrument. In one exemplary aspect, once a desired vibration state is detected and/or a desired G-loading state is detected, drilling can cease and the core barrel head assembly can record data relating to the orientation of the core, such as, for example and without limitation, gravitational field strength and direction, and/or magnetic field strength and direction.

Figure 5:
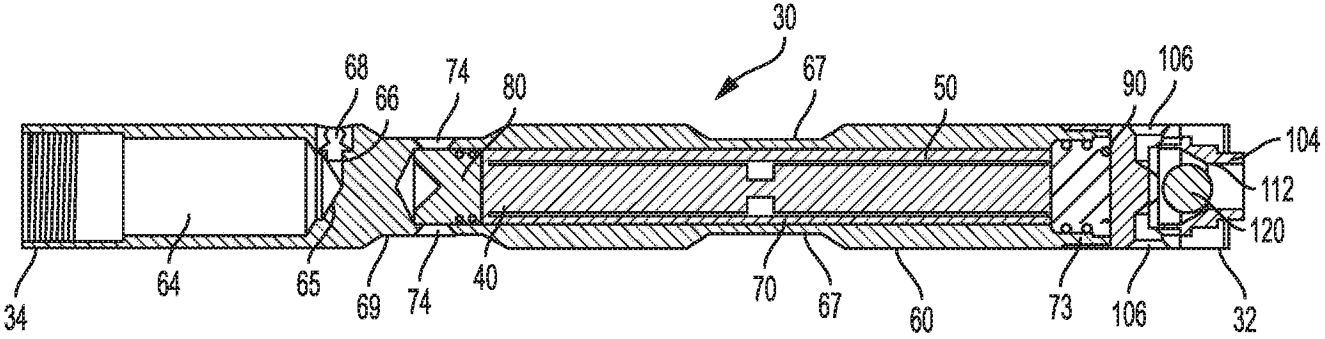
FIG. 5 shows a longitudinal cross-sectional view of the core barrel head assembly, showing an at least one electronic instrument and an electrically coupled power source disposed therein an interior cavity of a body of the core barrel head assembly.
Figure 6:
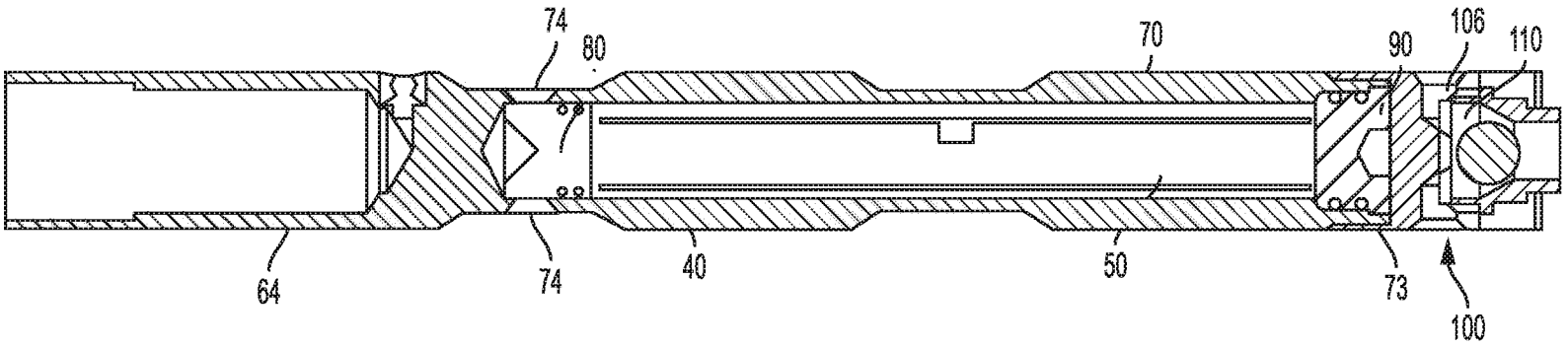
FIG. 6 shows a longitudinal cross-sectional view of another aspect of the core barrel head assembly, showing an at least one electronic instrument and an electrically coupled power source disposed therein an interior cavity of a body of the core barrel head assembly.
Figure 7:
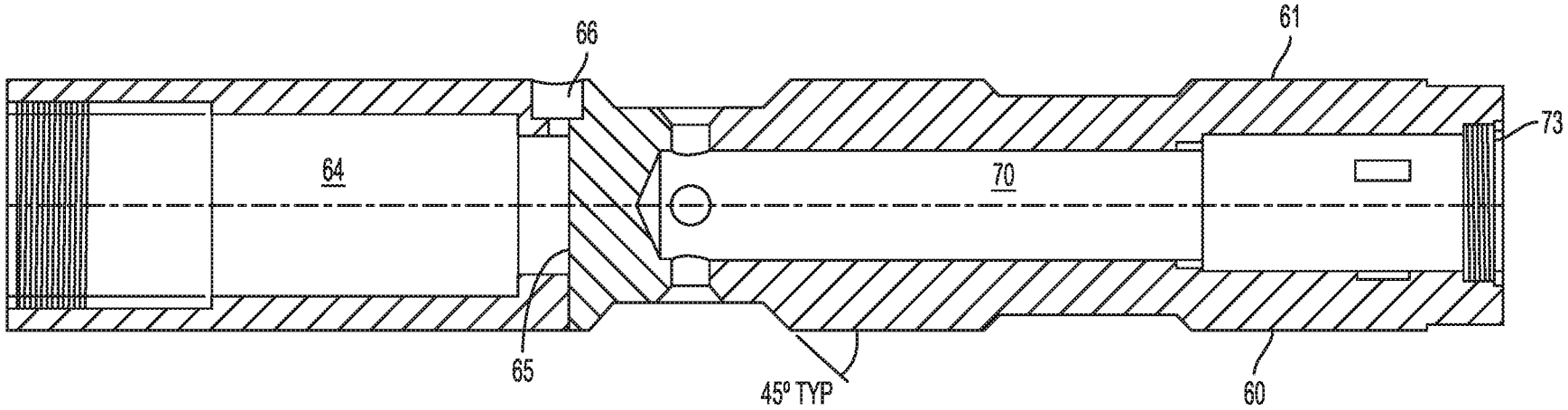
FIG. 7 shows a longitudinal cross-sectional view of the body of the core barrel head assembly.

The core barrel head assembly 30 has a proximal end 32 that is operatively oriented toward the drill bit end of the drill string and an opposed distal end 34. As shown in FIGS. 1 and 5-6, the core barrel head assembly 30 has an elongate tube body 60 that is conventionally joined to a conventional wire line retrieval portion of a head assembly 10. Thus, the head assembly of the drill string is complete without the necessity for the use of an unwieldy extension tube as required in the prior art designs.

The threaded proximal end 62 of the elongate tube body 60 is in communication with a first interior cavity 64 that extends distally to a base portion 65. Proximate the base portion of the second interior cavity, a port 66 is defined that extends from the exterior surface of the elongate tube body into fluid communication with the first interior cavity. Optionally, in this aspect, it is contemplated that a grease fitting 68 can be mounted in the port 66 to allow for selective passage of grease or lubricant into communication with the first interior cavity and vice versa.

A second interior cavity 70 is defined therein the elongate tube body 60 that is spaced from and extends distally from the first interior cavity. The second interior cavity 70 can be sized to hermetically enclose at least one of the least one electronic instrument 40 that is configured to obtain orientation data, the power source 50 and the communication means to receive and/or transmit orientation data. In another aspect, the second interior cavity 70 can be sized to hermetically enclose the least one electronic instrument 40 that is configured to obtain orientation data and the power source 50. In one aspect, the at least one electronic instrument 40 can comprise the electronic instrument discussed above and schematically shown in FIGS. 8 and 9. The at least one electronic instrument 40 is operatively electrically coupled to the power source 50, which can comprise any conventional power source, such as, for example and without limitation, a battery, a rechargeable battery, and the like.

In one aspect, as shown, a plurality of windows 74 can be defined in the elongate tube body that extend from the exterior surface 61 of the elongate tube body into the second interior chamber 70 proximate the closed proximal end 72 of the second interior chamber. In a further aspect, an orientation indicator module 80 can be provided that comprises a plurality of light emitters 82. The orientation indicator module 80 can be sized and shaped to sealingly close the second interior chamber from any intrusion of pressurized fluid into the second interior chamber 70 via the defined plurality of windows 74.

In another aspect, it is contemplated that the second interior cavity can comprise at least one orienting slot defined therein. In this aspect, the orientation indicator module can be oriented manually and the desired position can be maintained to the at least one O-ring seal 84 described below. Optionally, in a further aspect, the orientation indicator module 82 is configured to orient or otherwise position a plurality of light emitters 88 so that each light emitter underlies one window.

In one aspect, the orientation indicator module 80 can further comprise a sealing means for preventing any pressurized fluid from entering the second interior cavity 70 from the defined windows 74. In one aspect, the sealing means can comprise at least one O-ring seal 84 that is mounted on an exterior portion of the orientation indicator module and that is configured to seal between the exterior portion of the orientation indicator module and a portion of the interior surface of the second interior cavity.

In one exemplary aspect, light from the plurality of light emitters 88 (e.g. LEDs, and the like) passes through or can be observed through the plurality of windows 74. Reference arrow A refers to the drill bit end direction, and reference arrow B refers to the head assembly direction. Further, as described above, the process of obtaining core orientation is made easier by only requiring two color lights, such as, for example and without limitation, green and red, to indicate one or other direction of rotation to establish correct core orientation prior to marking. The indicators form part of the sealed device and can be low power consumption LED lights.

Alternatively, flashing lights may be used, such as, for example and without limitation, a certain frequency or number of flashes for one direction and another frequency or number of flashes for the other direction of rotation. A steady light could be given when correct orientation is achieved. Thus, advantageously, when the core barrel head assembly 30 and the core sample are recovered from down the hole, the core barrel head assembly 30 need not be separated from the drill string in order to determine a required orientation of the core sample. Wireless communication to a remote device, such as a hand held device, to transfer data between the core barrel head assembly and the remote device, can also be effected by transmitting through the at least one aperture.

In another aspect, the second interior cavity 70 extends distally to the open distal end 73 of the elongate tube body 60. To further effect a hermetical enclosure of the least one electronic instrument 40 that is configured to obtain orientation data, the power source 50 and, optionally, the communication means to receive and/or transmit orientation data, a seal coupler 90 can be provided that is configured to be sealingly received in the open threaded distal end 73 of the elongate tube body 60. As noted, a sealing means can be provided to prevent any pressurized fluid from entering the second interior cavity. In one aspect, the sealing means can comprise at least one O-ring seal 95 that is mounted on a portion of the seal coupler and that is configured to seal between a portion of the seal coupler and a portion of the interior surface of the open distal end of the elongate tube body.

In a further aspect, to further effect a hermetical seal of the second interior cavity and to provide fluid control for the wire line operation, a check valve assembly 100 is provided. In one aspect, the check valve assembly 100 comprises a coupled proximal end assembly and a distally tapered seat that defines an interior chamber 110 for operative receipt of a check ball 120.

In one aspect, the proximal end assembly 102 of the check valve assembly can define a female threaded coupling that is configured to be threadably coupled to the male threads defined on the exterior surface of the distal end 73 of the elongate tube body 60. As one skilled in the art will appreciate, as the proximal end assembly of the check valve assembly 100 is threadably coupled to the distal end 73 of the elongate tube body, the seal coupler 90 is driven into a sealed position therein the second interior cavity 70 to affect complete hermeticity.

Further, as one skilled in the art will appreciate, because the orientation indicator module 90 is sealingly disposed in the proximal end of the second interior chamber 70, the least one electronic instrument 40, the power source 50 and, optionally, the communication means to receive and/or transmit orientation data is disposed in operative contact with the orientation indicator module, and the seal coupler 90 is disposed in contact with the least one electronic instrument 40, the power source 50 and, optionally, the communication means to receive and/or transmit orientation data, as the proximal end assembly of the check valve assembly is threadably coupled to the distal 73 end of the elongate tube body, both the sealing means on the respective orientation indicator module 80 and the seal coupler 90 are driven into a sealed position therein the second interior cavity to affect complete hermeticity of the second interior cavity.

In another aspect, the interior chamber 110 of the check valve assembly extends to a distal end 104 of the check valve assembly. In this aspect, at least one port 106 is provided that extends from the exterior surface of the check valve assembly and is in fluid communication with the interior chamber of the check valve assembly. In one aspect, the at least one port 106 can comprise a plurality of ports. In this aspect, it is contemplated that the plurality of ports can be angularly spaced an equal or an unequal number of degrees apart.

In this aspect, the interior chamber 110 can have a distally tapered seat 112 that is adapted to selectively receive the ball 120 that is sized to selectively block the distally tapered seat. One skilled in the art will appreciate that the interior chamber 110 of the check valve assembly 100 can be sized and shaped to allow the ball to selectively move axially between an open position, in which the ball is spaced proximally away from the surface of the tapered seat so that pressurized fluid can move through the distal end of the check valve assembly and subsequently through the interior chamber to exit out of the at least one port, and a closed position, in which the ball is pressurized against the surface of the tapered seat so that pressurized fluid cannot move through the check valve assembly.

In a further aspect, the exterior surface 61 of the elongate tube body 60 can define a plurality of female planar stops 67 proximate the mid-body portion. These female planar stops aid in grasping and selectively orienting the orientation of the core barrel head assembly 30. Optionally, additional female planar stops 69 can be defined proximate the indicator widows defined in the elongate tube body to aid in ease of selectively orienting the sample.

Figure 8:
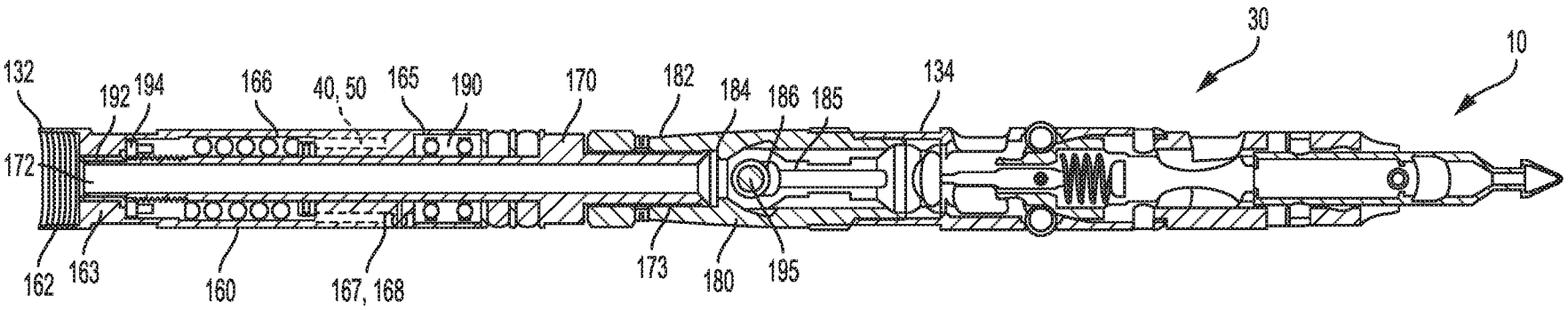
FIG. 8 shows a longitudinal cross-sectional view of a core barrel head assembly being operatively coupled to a head assembly.
Figure 9:
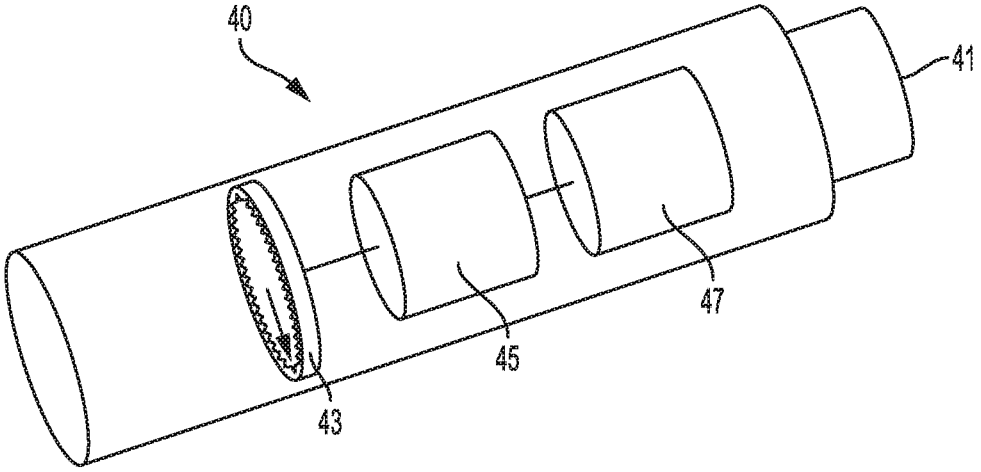
FIG. 9 shows a schematic view of an exemplary at least one electronic instrument.

Referring now to FIG. 8, an alternative embodiment of the core barrel head assembly 30 is shown that comprises at least one electronic instrument 40 that is configured to obtain orientation data, a operatively electrically coupled power source 50 and communication means to receive and/or transmit orientation data.

In this aspect the core barrel head assembly 130 has a proximal end 132 that is operatively oriented toward the drill bit end of the drill string and an opposed distal end 134. As shown in FIG. 8, the core barrel head assembly 130 is conventionally joined to a conventional wire line retrieval portion of a head assembly 10. Thus, the head assembly of the drill string is complete without the necessity for the use of an unwieldy extension tube as required in the prior art designs.

The core barrel head assembly 130 has an elongate tube body 160 that is operably coupled to elongate hollow spindle 170 that is, in turn, operably coupled to a selectively open check valve assembly 180. The elongate tube body has a threaded proximal end 162 that defines an internal bushing mount 163. The open distal end 164 of the elongate tube body defines an internal shoulder 165 that is sized and shaped to receive at least one conventional cylindrical bearing 190.

A bushing 192 is mounted in the bushing mount and is sized and shaped to rotatably receive the proximal end 172 of the hollow spindle 170. As shown in the figures, a mid-portion of the hollow spindle is rotatably supported by the at least one bearing 190. In a further aspect, a nut 194 is coupled to a treaded portion 174 of the hollow spindle 170 adjacent to the proximal end of the hollow spindle 170.

The a portion of the interior wall 165 of the elongate tube body 160, a portion of the nut 194 and a portion of the exterior surface of the hollow spindle define a an interior cavity 166 into which a spring is mounted and the at least one electronic instrument 40 that is configured to obtain orientation data, a operatively electrically coupled power source 50 and communication means to receive and/or transmit orientation data are mounted. The least one electronic instrument 40 that is configured to obtain orientation data, a operatively electrically coupled power source 50 and communication means to receive and/or transmit orientation data can be integrated; potted or otherwise affixed to the elongate tube body within the interior cavity 166. As one skilled in the art will appreciate, as the hollow spindle turns, the elongate tube body will remain in the same position, i.e., the elongate tube body does not turn when the hollow spindle is turned.

In an optional aspect, a port 167 is defined that extends from the exterior surface of the elongate tube body into fluid communication with the interior cavity. Optionally, in this aspect, it is contemplated that a grease fitting 168 can be mounted in the port 167 to allow for selective passage of grease or lubricant into communication with the interior cavity.

Figure 10:
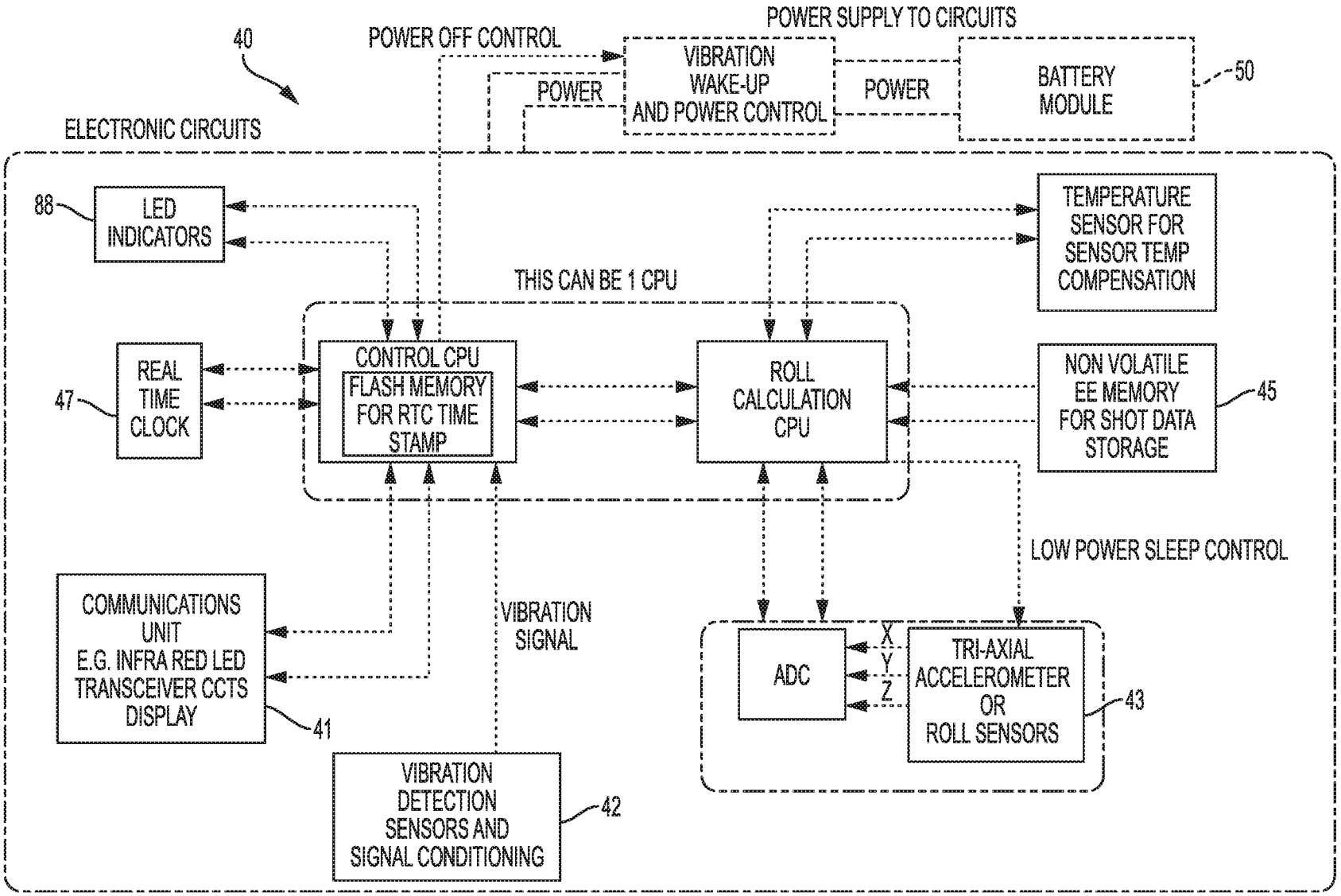
FIG. 10 shows a schematic view of an exemplary at least one electronic instrument and an electrically coupled power source for disposition therein an interior cavity of a body of the core barrel head assembly.

It is contemplated that the interior cavity 166 can be sized to hermetically enclose at least one of the least one electronic instrument 40 that is configured to obtain orientation data, the power source 50 and the communication means to receive and/or transmit orientation data. In another aspect, the interior cavity 166 can be sized to hermetically enclose the least one electronic instrument 40 that is configured to obtain orientation data and the power source 50. In one aspect, the at least one electronic instrument 40 can comprise the electronic instrument discussed above and schematically shown in FIGS. 9 and 10. The at least one electronic instrument 40 is operatively electrically coupled to the power source 50, which can comprise any conventional power source, such as, for example and without limitation, a battery, a rechargeable battery, and the like.

In a further aspect, to provide fluid control for the wire line operation, a selectively open check valve assembly 180 is provided. In one aspect, the check valve assembly 180 comprises a coupled end assembly 182 defining a proximally tapered seat 184 that defines an interior chamber 185 for operative receipt of a check ball 195.

In one aspect, the coupled end assembly 182 of the check valve assembly can define a female threaded coupling that is configured to be threadably coupled to the male threads defined on the exterior surface of the distal end 173 of the hollow spindle 170. Thus, as shown in the figures, the tapered seat 184 is operably coupled to the distal end 173 of the spindle 170 such that the hollow interior of the spindle 170 can be selectively placed in fluid communication with fluid governed by the check valve assembly 180.

As one skilled in the art will appreciate, the end assembly 182 of the check valve assembly defines at least one port 186 that extends from the exterior surface of the check valve assembly and is in fluid communication with the interior chamber of the check valve assembly. In one aspect, the at least one port 186 can comprise a plurality of ports. In this aspect, it is contemplated that the plurality of ports can be angularly spaced an equal or an unequal number of degrees apart.

In this aspect, the interior chamber 185 can have a proximally tapered seat 184 that is adapted to selectively receive the ball 195 that is sized to selectively block the proximally tapered seat. One skilled in the art will appreciate that the interior chamber 185 of the check valve assembly 180 can be sized and shaped to allow the ball to selectively move axially between an open position, in which the ball is spaced proximally away from the surface of the tapered seat so that pressurized fluid can move out through the elongate spindle into the proximal end of the check valve assembly and subsequently through the interior chamber of the check valve assembly to exit out of the at least one port, and a closed position, in which the ball is pressurized against the surface of the tapered seat so that pressurized fluid cannot move through the check valve assembly to through the hollow spindle.

In operation, it is contemplated that, in one non-limiting example, the at least one electronic instrument 40 of the core barrel head assembly 30 does not take any orientation measurements while vibrations, such as from the drilling operation, are present. In this aspect, the combination of mechanical, electromechanical and/or electronic sensors and software algorithms programmed into the at least one electronic instrument of the core barrel head assembly are configured to determine that the core barrel head assembly is in motion while descending down the hole and during drilling and is therefore not yet needed to detect breaking of the core sample from the body of material. Similarly, in a further aspect, it is contemplated that the at least one electronic instrument of the core barrel head assembly can be configured to detect that the core barrel head assembly is ascending to the surface for core retrieval after core breaking and subsequently will not take any core orientation measurements during the ascending operation.

In one non-limiting example, in operation, when the driller is ready to break the core, the driller can selectively not rotate the drill string for a first predetermined delay time period that can range from between about 10 seconds to about 90 seconds. During the delay time period, it is contemplated that an orientation and dip measurement can be taken during this non-rotation, i.e., minimal vibration, period. Subsequently, after breaking the core, the driller can wait a second predetermined delay time period that can range from between about 60 seconds to about 120 seconds, or at least 90 seconds before initiating further rotation.

Optionally, it is contemplated that pressure created within the borehole by drilling mud and/or water, which may be pumped down the borehole from the surface can be detected by the at least one electronic instrument 42, which can comprise at least one pressure sensor. In various non-limiting examples, the at least one pressure sensor can be mounted on the drill string, such as on the inner and/or outer drill tube or on the drill bit or on the core barrel head assembly. The detected pressure, such as, for example and without limitation, pressure within the inner tube receiving the core, or pressure differential, such as, for example and without limitation, pressure differential between/across the inner and outer tubes, can be indicative of the inner tube being nearly or totally full of core material. This can occur before the core is separated from the subsurface body of material (such as by breaking the core from the body by a sharp pull back on the core) and hence can provide an indicator that the core is about to be broken.

Optionally, it is contemplated that the least one electronic instrument 40, which is configured to obtain orientation data, the power source 50 and the communication means to receive and/or transmit orientation data can be sized and shaped to be integrally mounted therein conventional wire line assemblies. It this aspect, the least one electronic instrument 40 that is configured to obtain orientation data, the power source 50 and the communication means to receive and/or transmit orientation data can be miniaturized and/or flexible to be received within defined cavities therein the conventional wire line assemblies and can be subsequently hermetically sealed, such as with, for example and without limitation, an epoxy, therein the defined cavities.

One skilled in the art will appreciate that the core barrel head assembly 30 does not need to be separated from the head assembly 20 in order to determine core sample orientation and/or to gather data recorded by the tool means that there is less risk of equipment failure and drilling downtime, as well as reduced equipment handling time through not having to separate the sections in order to otherwise obtain core sample orientation. Known systems require an end-on interrogation of the tool. By providing a sealed apparatus and the facility to determine orientation of the core sample by observing the orientation indications through one or more windows 74 in the side of the elongate tube body 60, reliability and efficiency of core sample collection and orientating is improved. Consequently operational personnel risk injury, as well as additional downtime of the drilling operation. Without having to separate core barrel head assembly 30 from the head assembly, the orientation of the core sample can be determined and the gathered information retrieved with less drilling delay and risk of equipment damage/failure.

Further, unlike known systems, the core barrel head assembly 30 provides for the desired flow of pressurized fluid in the wire-line assemblies to conventionally operate the fluid control vales that are commonly used in wire-line operations. As noted, the check valve assembly 100 allows for the selectively passage of fluid therethrough that assembly and to the exterior surface of the core barrel head assembly 30 and subsequently through the pressure relief valve to exit out of the first interior cavity of the elongate tube body.

In one aspect, the one or more pressure sensors 42 can be provided to detect pressure data, which can comprise pressure readings; changes in pressure and/or pressure differentials. The pressure data can be operative communication with the core barrel head assembly 30 and/or an operator at the surface. In one exemplary aspect, once a desired pressure value is detected, drilling can cease and the at least one electronic instrument 40 of the core barrel head assembly 30 can record data relating to the orientation of the core, such as gravitational field strength and direction, and/or magnetic field strength and direction.

In various aspects, it is contemplated that the recorded data can optionally include "dip" angle or azimuth datum to increase the reliability of the core orientation results. Conventionally, dip is the angle of the inner core tube drill assembly with respect to the horizontal plane and can be the angle above or below the horizontal plane depending on drilling direction from above ground level or from underground drilling in any direction. This provides further confirmation that the progressive drilling of a hole follows a maximum progressive dip angle which may incrementally change as drilling progresses, but not to the extent which exceeds a dogleg severity, i.e., a normalized estimate (e.g. degrees/30 meters) of the overall curvature of an actual drill-hole path between two consecutive directional survey/orientation stations.

In operation, prior to obtaining an orientation and core sample, a remote external communication device can be set by an operator to a start time. The remote external communication device communicates with the at least one electronic instrument 40 of the core barrel head assembly 30 before it is tripped into the drill hole. Subsequently, after a predetermined timed interval has elapsed from the start time, the at least one electronic instrument 40 can be configured to begin normal operation to detect the signature of vibration indicating a core break.

Optionally, in another aspect, pressure changes or levels can be detected to indicate a pre-break condition or period, such as pressure of mud/water within the inner tube increasing due to the core filling or nearly filling the inner tube holding the core.

In one aspect, the at least one electronic instrument 40 of the core barrel head assembly 30 can be configured to not take any orientation measurements while vibrations, such as from the drilling operation, are present. In this aspect, the combination of mechanical, electromechanical and/or electronic sensors and software algorithms programmed into the at least one electronic instrument 40 of the core barrel head assembly 30 can be configured to determine that the core barrel head assembly is in motion while descending down the hole and during drilling and is therefore not yet needed to detect breaking of the core sample from the body of material. Similarly, in a further aspect, it is contemplated that the at least one electronic instrument 40 of the core barrel head assembly 30 can be configured to detect that the core barrel head assembly is ascending to the surface for core retrieval after core breaking and subsequently will not take any core orientation measurements during the ascending operation.

Optionally, dip angle can be included in determining orientation of the core. In one aspect, the dip angle of the drill hole can be used to determine whether or not to use the obtained orientation data. For example, a valid core orientation sample can be determined from the previously discussed validation steps being acceptable and, additionally, from the dip angle of the drill hole also being within acceptable limits. In one aspect, the dip can be sampled as a reference prior to the first run of a new drill hole. This particular reference is called a setup function. In this aspect, the setup function can be selected on the remote communications device, which then communicates to the core barrel head assembly. For clarity, the core sample orientation subassembly does not orientation the core, rather, it records signals indicative of the orientation of the core to be retrieved. The core barrel head assembly can then be lowered down the hole or aligned to the angle of the drill rods in the case of no hole yet to be drilled. Once the core barrel head assembly is down to a desired position or to the end of the hole the user can "mark" the "shot," preferably via use of the remote communications device.

Subsequently, the core barrel head assembly is retrieved and the remote communications device can be used to communicate the dip (angle) of the drill hole to the communication means of the core barrel head assembly. Optionally, the dip of the end of the hole can be manually entered into the remote communications device and this communicated back to the core barrel head assembly.

In one aspect, a compliant datum is obtained when one or more signals indicative of the orientation of the core is/are obtained by the core orientation device during a period of no drilling vibration prior to detecting vibration from breaking the core and that being prior to a subsequent period of no drilling vibration. It is contemplated that one or more embodiments can utilize the final compliant datum instead of the first obtained compliant datum.

In one aspect, it is contemplated that the at least one electronic instrument 40 can comprise an LCD display 41 at one end. This can allow for setting up of the orientation system prior to deployment and to indicate visually alignment of the core sample when retrieved to the surface. The core barrel head assembly 30 can be connected to the core barrel head assembly which can be operably is connected to a sample tube for receiving a core sample. In one aspect, and as exemplarily shown in FIGS. 8 and 9, the at least one electronic instrument 40 can comprise at least one vibration sensor, at least one accelerometer 43, a memory 45, a timer 47 and the aforementioned LCD display 41. Optionally, at least one electronic instrument 40 can further comprise one or more of at least one of a gravity sensor, magnetic field sensor, inclinometer, a direction measuring sensor, a gyro, and/or preferably a combination two or more of these devices.

In this aspect, the at least one electronic instrument 40 can be configured to record orientation data every few seconds during core sampling. The start time can be synchronized with actual time using a common stop watch. The operably coupled core barrel head assembly 30 and the core barrel head assembly can then be lowered into the drill string outer casing to commence core sampling. After drilling and capturing a core sample in the inner core sample tube, the operator, can stop the stop watch and retrieve the core sample tube back to the surface. At the surface, before removing the core sample from the inner tube, the operator can views the LCD display, if it is still working, which steps the operator through instructions to rotate the core tube until the core sample lower section is at the core tube lower end. The core sample is then marked and stored for future analysis.

Another aspect of the present invention provides a method of conducting a down hole survey of drilling, the method including: a) drilling the core from a subsurface body of material; b) recording data relating to orientation of the core to be retrieved, the data recorded using the at least one electronic instrument of the core barrel head assembly, c) separating the core from the subsurface body, and d) obtaining an indication of the orientation of the core based on the recorded core orientation data obtained before the core was separated from the subsurface body.

Optionally, the method can comprise: determining that drilling has ceased for a period of time, using the at least one electronic instrument of the core barrel head assembly to record data relating to orientation of the core to be retrieved, separating the core from the subsurface body, retrieving the core to the surface, and obtaining an indication of the orientation of the core based on the recorded core orientation data obtained once the drilling had ceased and before the core was separated from the subsurface body.

Figure 11:
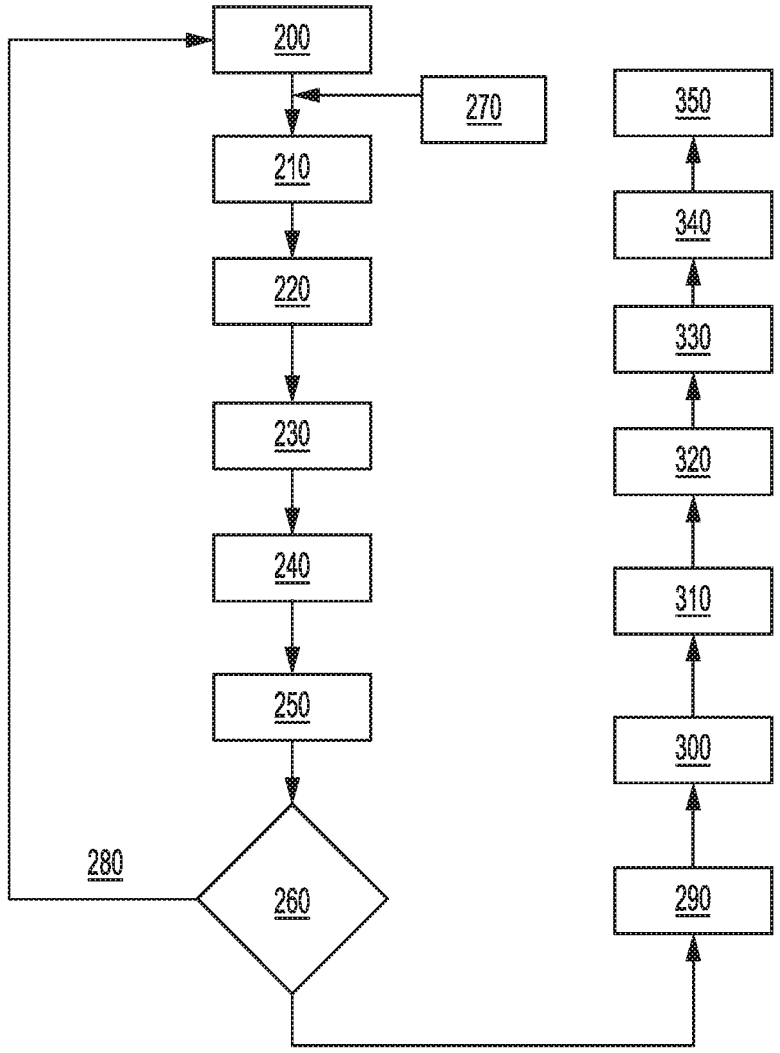
FIG. 11 shows an exemplary high level flowchart relating to a method of using the present invention.

In one exemplary aspect, for the embodiment shown in the flowchart in FIG. 11, the core orientation can be validated when the following events have occurred:

a) Step 200: detecting no vibration above a threshold by the core barrel head assembly, or is detected to be below a threshold, for the first predetermined delay time period;
b) Step 220: taking a core orientation measurement during the first predetermined delay time period;
c) Step 230: detecting noise from breaking the core from the subsurface body after the first predetermined delay time period and before the second predetermined delay time period;
d) Step 240: detecting no vibration above a threshold by the core barrel head assembly, or is detected to be below a threshold, for the second predetermined delay time period;
e) Step 250: retaining the orientation measurement obtained in Step 220 only if Steps 200, 230 and 240 are present;
f) Step 260: disregarding detected signals or to not detect vibration or lack of vibration if only if Steps 200, 230 and 240 are obtained. If the detected signals are disregarded, a vibration silence signal in Step 280 must be detected before the core is broken.

Optionally, as shown in Step 270, a dip measurement can be obtained during the period of no drilling prior to breaking the core (period Y), preferably if dip is within the set limits.

In one aspect, once the required core orientation is obtained, the core barrel head assembly may be shut down or turned to low power standby mode in Step 290 in preparation to be subsequently placed into an orientation mode. Once the core barrel head assembly 30 is retrieved to the surface in Step 300, an operator can set the core barrel head assembly to the orientation mode in Step 310. In one example, and not meant to be limiting, this can be done via the remote communication means for communicating with the communication means of the core barrel head assembly in Step 320.

In a further aspect, it is contemplated that the core barrel head assembly can comprise an orientation indicator assembly that comprises one or more lights or other visual indicators, such as, for example and without limitation, one or more display panels to give an indication of orientation direction and required orientation for marking the core. In this aspect, once in orientation mode, visual indications, such as flashing of one or more LEDs, can indicate to the operator which direction to rotate the core to find the"correct down side" for marking. In this aspect, the "correct downside" is the part of the core that was lowermost prior to separating from the subsurface body.

Once the correct downside is identified in Step 330, the operator can again effect communication to the communication means of the core barrel head assembly via the remote communication device. In Step 340, and based on the orientation data recorded, the remote communication device can be configured to verify that the correct orientation was achieved. Subsequently, in Step 350, the operator can perform another orientation operation.

Figure 12:
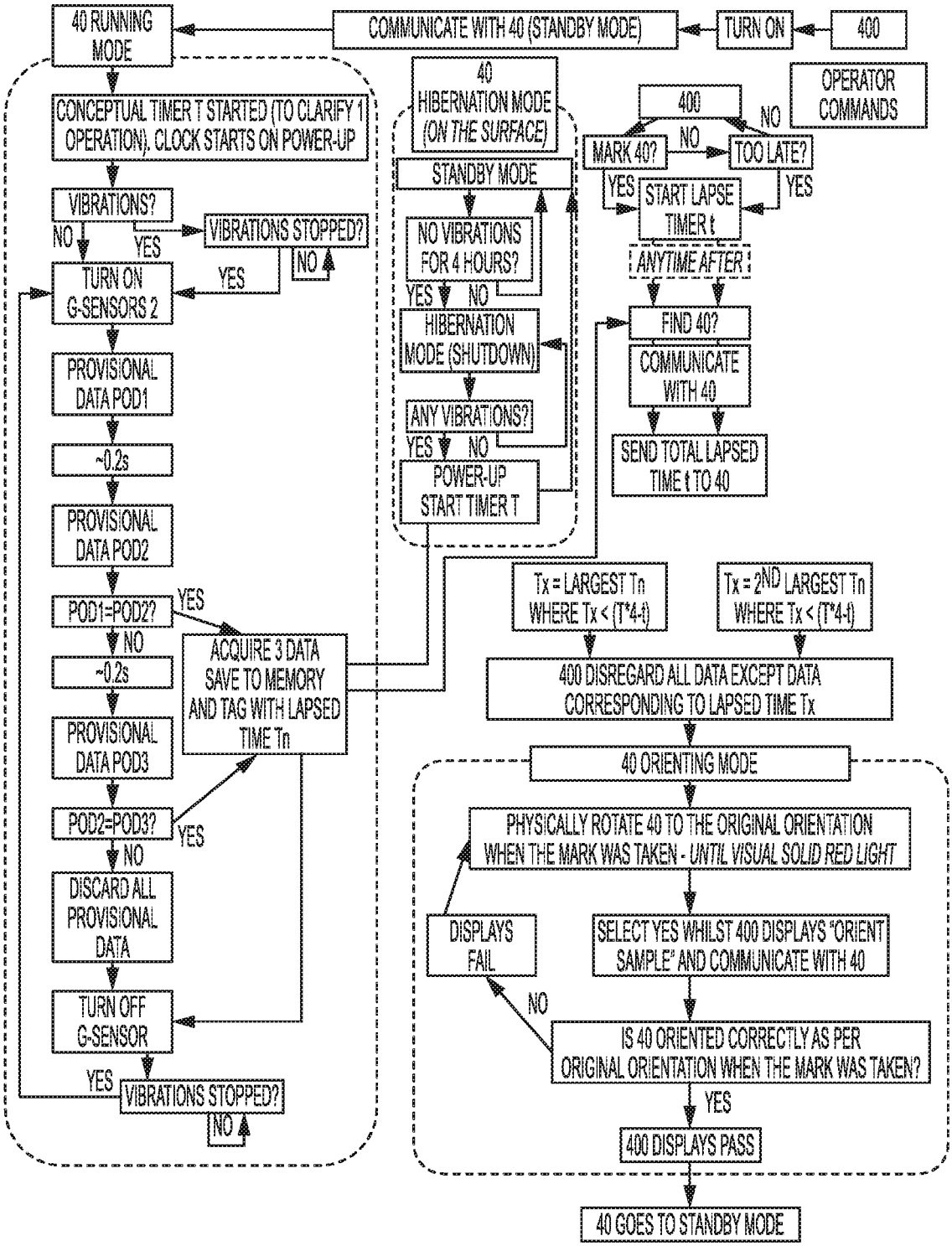
FIG. 12 shows an exemplary flowchart relating to an alternative embodiment of a method of using the present invention.
Figure 13:
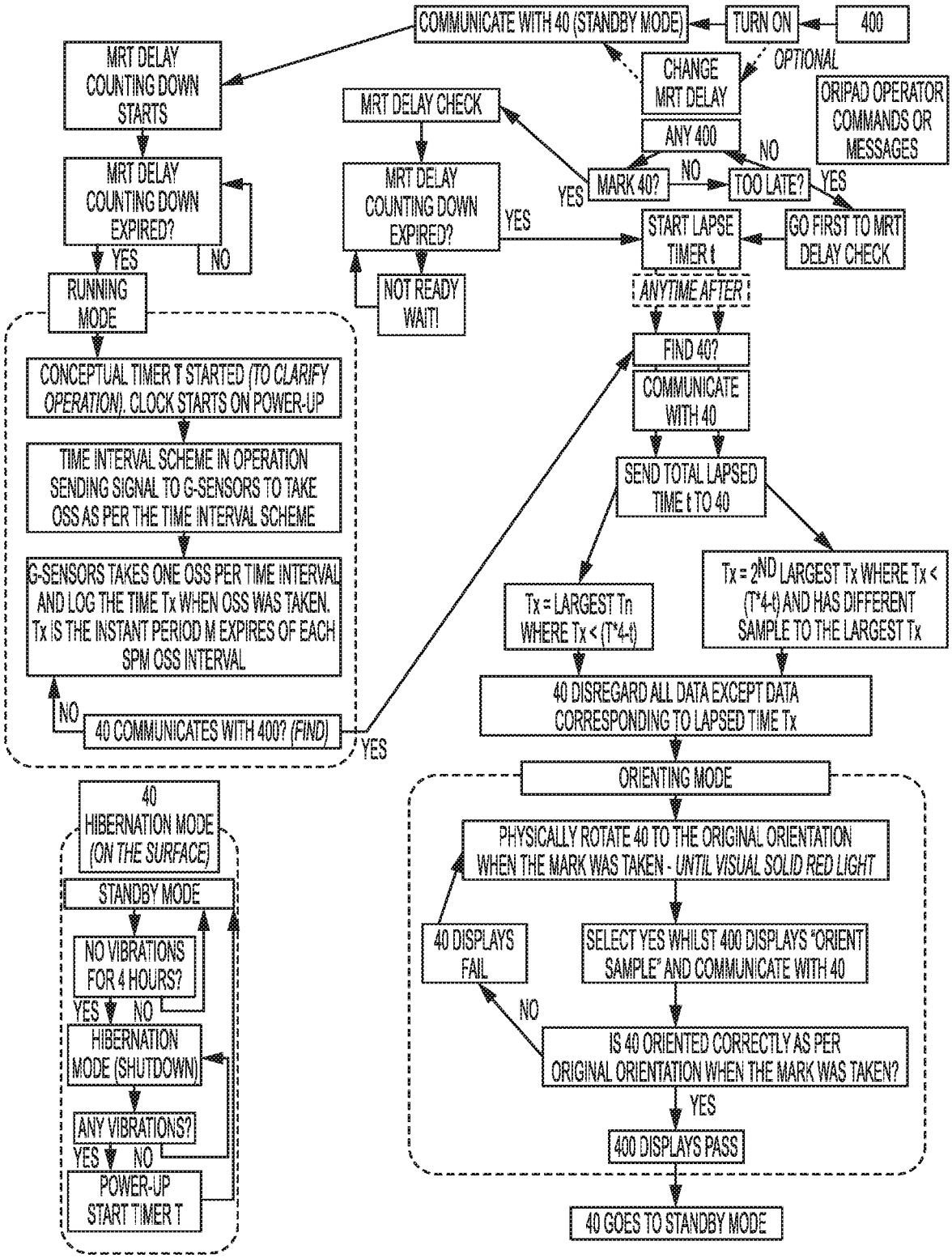
FIG. 13 shows an exemplary flowchart relating to an alternative embodiment of a method of using the present invention.

Optional and exemplary methods of using the present invention are shown in FIGS. 12 and 13. In one aspect, as shown in FIG. 12, the at least one electronic instrument 40 of the core barrel head assembly 30 can be programmed to be used in a running mode, a hibernation mode and an orientating mode. In this aspect, the at least one electronic instrument 40 of the core barrel head assembly 30 is configured to actuate and take sequential provisional data readings (POD1, POD2, POD3, etc.) when the at least one electronic instrument senses that vibrations have stopped. These provisional data readings are taken as desired time intervals that can be between about 0.1 to about 1.0 seconds. In this aspect, the core barrel head assembly 30 is configured to actuate or power up when the at least one electronic instrument is taken out hibernation. Further, it is contemplated that the time clock starts operation whenever the at least one electronic instrument 40. For example, this could happen on the surface prior to insertion into the hole. The programming can also optionally disregard any acquired provisional data (POD1, POD2, POD3, etc.) if vibrations are sensed during any portion of the acquisition of the sequential provisional data readings. In this case, the programming would automatically go to the step "Turn Off G-Sensor" in the running mode.

In one aspect, as shown in FIG. 13, the at least one electronic instrument 40 of the core barrel head assembly 30 can be similarly programmed to be used in a running mode, a hibernation mode and an orientating mode. In this aspect, the at least one electronic instrument 40 of the core barrel head assembly 30 is configured to actuate in accord with a time interval scheme in which a signal is sent to the tri-axial g-sensors to take readings in accord with the predetermined time interval scheme.

In one aspect, it is contemplated that the core barrel head assembly 30 can be utilized in asynchronous time operation for core sampling. In this aspect, the data recording events taken by the core barrel head assembly 30 are not synchronized in time with the communication device. That is, the core barrel head assembly can be programmed to not commence timing from a reference time, and can optionally be programmed such that the at least one electronic instrument 40 of the core barrel head assembly 30 does not take samples (shots) at specific predetermined time intervals. For example, and not meant to be limiting, the at least one electronic instrument 40 of the core barrel head assembly 30 can be programmed to not take a three second sample every one minute with that one minute interval synchronized to the remote, which would therefore know when each sample is about to take place. In this aspect, the communication means or device is not synchronized to the core orientation unit, i.e. asynchronous operation, and therefore the communication device does not know if or when a sample is being taken. Thus, obtaining an indication of core sample orientation is simplified over known arrangements.

In one aspect, while the core barred head assembly is on the surface, the external communication device can signal to the at least one electronic instrument 40 to activate or come out of a standby mode prior to deployment down hole. Optionally, the at least one electronic instrument 40 can already be activated such that it is not necessary to have the at least one electronic instrument 40 switch on from a deactivated ('turned off') state.

Alternatively, the at least one electronic instrument 40 can be configured to activate and commence taking data samples after a predetermined period from deployment from the surface or after elapse of an activation delay timer or other delay mechanism. For example, the data gathering device may be configured at the surface to only 'wake-up' from a standby mode to an activated mode after at least a predetermined period of time has elapsed or a counter has completed a predetermined count relating to a time period delay.

In one aspect, it is contemplated that the at least one electronic instrument 40 can be programmed to take measurements/record orientation data based on the time intervals and/or randomly generated time intervals. In this aspect, the programmed instructions to record data generated as a result of the regular or randomly generated time intervals can remain on-going while the at least one electronic instrument 40 activated. However, because at least one of the sensor(s) in the at least one electronic instrument 40 may be shut down/deactivated during sensed vibrations, no orientation data gets acquired during time period in which vibrations are sensed. When the vibrations stop, the sensors are turned on and the time intervals instructions would then resume execution as per the time regular or random intervals. In this aspect, orientation data is being measured/obtained per the time intervals being used, as preferably initiated at the beginning of the run or after a delay timer. But, data will not be recorded during the time intervals due to the fact that the sensor(s) will be off/deactivated, e.g. during a time period in which vibrations are sensed. In this aspect, when drilling ceases, which results in vibrations ceasing, data will be taken, and may preferably continue to be taken, in accordance with the time intervals scheme initiated at the surface, and preferably may always running in the background even when the sensor(s) is/are off or deactivated (e.g., asleep).

In a further aspect, the at least one electronic instrument 40 can log and/or record orientation related data down hole at intervals (regular or randomly generated intervals within minimum and maximum interval time limits) and can also measures total lapsed survey time T.

In a further aspect, the at least one electronic instrument 40 can be started by an external communication device at the surface but a second, different, communication device can be used to 'mark' (to set) the point in time, i.e., to commence the elapsed period of time t relating to breaking the core sample from the underlying rock and thereby be used for identifying the data set recorded immediately before that break.

In one aspect, to compensate for taking regular or random time period orientation measurements, which uses up battery power as the at least one electronic instrument 40 advances down hole, a start delay can be provided. For example, when the external communication device at the surface is operated, e.g., turned on, an option to set a delay time in the at least one electronic instrument 40 may be displayed. For example, a delay in minutes between 0 to 99 minutes might be displayed. In this aspect, when the at least one electronic instrument 40 is started-up and the communication device communicates the delay period to the at least one electronic instrument 40, the timer in the at least one electronic instrument 40 will allow the delay period to elapse before any orientation measurements are recorded.

In one aspect, orientation data can be recorded while drilling is ceased and closest to time Tx, where Tx is preferably less than or equal to T-t, and where T is the time recorded by the at least one electronic instrument 40 (survey time) and t is the elapsed time recorded by the external communication device that was commenced once drilling ceased and the orientation data was recorded. In this exemplary aspect, it will be appreciated that the required recorded data may be at a time Tx greater than T-t, i.e., if the drilling remained ceased after commencing the elapsed time and separating (breaking) the core sample from the rock was delayed while the at least one electronic instrument 40 recorded orientation data. Thus, Tx can be greater than T-t providing no drilling activity takes place after drilling ceases and before the core is broken from the underlying rock. In this aspect, in operation, when the core barrel head assembly 30 is retrieved back at the surface with the core sample), the external communication device interrogates the at least one electronic instrument 40 to identify the recorded core orientation data closest to T-t, i.e., the timer of the external communication device is not synchronised to the timer of the at least one electronic instrument 40, and both timers are not commenced at a reference time.

For example and without limitation, orientation data may be recorded by the at least one electronic instrument 40 at regular irregular intervals of time within a known range of allowed time intervals, such as one or more of 10s, 15s, 20s or 30s intervals within a range of 1s to 1 minute. It is contemplated that the time intervals can be generated by a random (time) number generator operating within the minimum and maximum allowed range. Thus, the time intervals for obtaining orientation data may be repeated (e.g. 10s, 10s, 10s, 20s, 20s, 10s . . . ). In this exemplary aspect, data recording events ('shots') are therefore not constantly taken on a set time period. However, it is contemplated that predetermined set time intervals may be used. That is, the at least one electronic instrument 40 may record orientation data every time interval, preferably up until the core is broken form the underlying rock, though recording may also continue afterwards.

In operation, the at least one electronic instrument 40 can be deployed down hole. Optionally, the at least one electronic instrument 40 can be started at the surface and its timer commence the survey time timing at the surface, or the timer can have a delay to save power until the at least one electronic instrument 40 is all or partway down the borehole. Subsequently, when the core sample has been captured sufficiently in the core tube, drilling ceases and during this period of non-drilling, the at least one electronic instrument 40 records orientation data relating to its own orientation in the borehole, and therefore, of the associated core sample that is captured in the core barrel head assembly 30, which cannot rotate unless the at least one electronic instrument 40 also rotates. Next, the core sample is broken away from the underlying rock and the core barrel head assembly 30 is retrieved to the surface.

In one aspect, an external communication device can record the elapsed time t by a user, i.e., commencing the timer in the handheld external communication device at the surface. This is preferably either when drilling has ceased or immediately before breaking the core from the rock while drilling has ceased, or immediately after the core is broken. However, it will be appreciated that the elapsed time can be commenced after the core is broken away from the underlying rock because the at least one electronic instrument 40 can be programmed to identify the nearest recorded data older than the commencement of the elapsed time that occurred during no drilling. In this aspect, the external communication device retains a record of the elapsing time.

When the at least one electronic instrument 40 and core barrel head assembly 30 containing the core sample are retrieved to the surface, the user can interrogate the at least one electronic instrument 40. In this aspect, once the at least one electronic instrument 40 confirms receiving the interrogation command, the communication device can command halting of the survey time T (stopping the at least one electronic instrument 40's timer) and elapsed time t (stopping the external communication device's timer). In this aspect, the external communication device can instruct the at least one electronic instrument 40 to identify the recorded orientation data from immediately before or after the commencement of the elapsed period of time going back from the end of the survey time, i.e., the at least one electronic instrument 40 has to 'look back' in time for the data recorded at or around the elapsed ago. In this aspect, the at least one electronic instrument 40 subtracts the elapsed time t from its survey time T to provide a time Tx associated with the required recorded data obtained when drilling was ceased.

In this aspect, once the correct recorded orientation data is identified in its memory, the at least one electronic instrument can go into orientation mode so that the core sample can be orientated and that orientation recorded. In one exemplary aspect, recording of orientation data by the at least one electronic instrument 40 is triggered on a time interval basis; this may be by the regular or random time intervals mentioned above. Recording the orientation data may only commence once the time delay has ended. For example, the timer within the at least one electronic instrument 40 may be running from deployment (or before) of the device into the borehole. However, the delay may prevent the device from recording orientation data until the delay has ended. Once the delay has ended, orientation data is recorded according to the prevailing time interval sequence, i.e., randomly generated time intervals or regular time intervals.

Optionally, when vibration or other motion of the at least one electronic instrument 40 stops down hole sufficiently, the at least one electronic instrument 40 may resume recording orientation data according to the prevailing time interval regime or may switch to another time interval regime for sensing and recording orientation.

Optionally, the at least one electronic instrument 40 can be programmed to identify core orientation data recorded before breaking of the core sample but based on an elapsed time period commenced after breaking the core sample. The at least one electronic instrument 40 can be programmed to identify the recorded orientation data that that was recorded before commencement of the elapsed time. In a further aspect, the recorded data can be recorded after breaking of the core sample because of the time interval recording regime. In this aspect, if that data set was recorded while nothing was moving down hole (and has not moved since breaking the core), the data set can be trusted to be sufficiently accurate. It can be compared with one or more previous data sets, and if they concur, then can be deemed sufficiently accurate for orientation purposes. Only one of those data sets is needed and any other of them may be discarded or disregarded.

In a further aspect, it is contemplated that operation of the at least one electronic instrument 40 to commence recording orientation data can be initiated at the surface and device then deployed into the borehole. Commencement of recording orientation data can also be delayed, so as to save battery power by avoiding taking unnecessary or unusable orientation measurements whilst the device is progressing down the borehole. Orientation measurement immediately before or after breaking the core sample from the underlying rock is/are required. In one exemplary aspect, the at least one electronic instrument 40 can have a delay preventing recording of orientation data until the delay ends.

In another aspect, the at least one electronic instrument 40 can take orientation measurements periodically, such as at random or regular periods of time, and record one or more of those measurements. Preferably the at least one electronic instrument 40 can be in a sleep mode, change to a power-up (wake-up) mode and then take a measurement, and re-enter sleep each interval. In one aspect, if two or more consecutive orientation measurements are the same, the at least one electronic instrument 40 can ignore, not record or delete from memory unnecessary repeat measurements and only retain one of the repeat measurements, preferably being the first of the identical measurements. In this aspect, each recorded measurement of orientation can be tagged or 'time stamped', preferably relative to the timer running in the at least one electronic instrument 40, i.e., the recorded orientation data is given a time stamp Tx, where x is the particular time within the survey timeframe running in the device. Thus, Tx is the time since the survey time T commenced that that orientation data set was recorded. It is contemplated that Tx can be a real time or cumulative time since commencement of the survey time T. Thus, in this aspect, the at least one electronic instrument 40 can have a real time clock type timer or a 'start-stop' (counter or stopwatch) type timer. When drilling ceases and the core is to be broken from the underlying rock (because there is sufficient core sample in the core barrel), a 'mark' is taken, which commences an elapsed time t at the surface. In this aspect, it is contemplated that this mark can be taken before or after the break at either regular or irregular time intervals.

Figure 14:
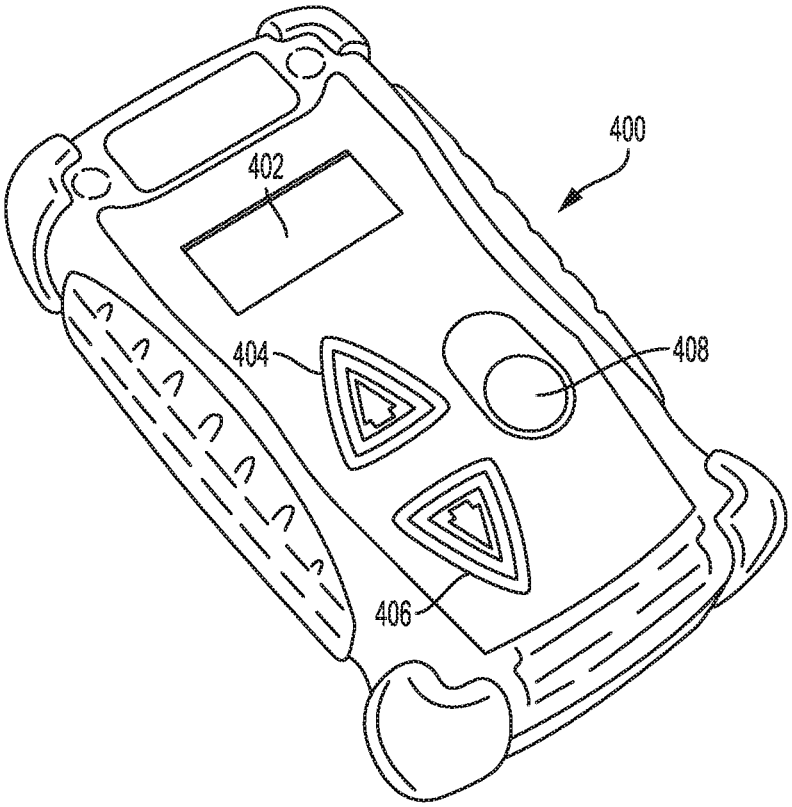
FIG. 14 shows an exemplary prior art hand held device for wirelessly interrogating the core barrel head assembly of the present invention.

Referring now to FIG. 14, an exemplary known hand held device 400 which receives wirelessly receives data or signals from the communication means of the core barrel head assembly. In this aspect, communication means of the core barrel head assembly comprises a transmitter which can use line of sight data transfer through the window, such as by infra-red data transfer, or a wireless radio transmission. The communication device 400 can store the signals or data received from the communication means of the core barrel head assembly. In one aspect, the communication device 400 can comprise a display 402, navigation buttons 404, 406, and a data accept confirmation button 408.

In one aspect, setting up of the core barrel head assembly 30 can be carried out before insertion into the drill hole. Data retrieval can be carried out by infrared communication between the communication means of the core barrel head assembly and a core orientation data receiver or communication device 400. In this aspect, after recovering the core sample inner tube back at the surface, and before removing the core sample from the tube, the operator can optionally remove the head assembly. The operator can use the remote communication device to obtain orientation data from the communication means of the core barrel head assembly using a line of sight wireless infrared communication between the remote device and communication means of the core barrel head assembly. However, it will be appreciated that communication of data between the communication means of the core barrel head assembly and the communication device 400 can be by other wireless means, such as by radio transmission.

In this prior art aspect, the whole inner tube, core sample, and core barrel head assembly can be rotated as necessary to determine a required orientation of the core sample. The indicators on the proximal end of the core barrel head assembly indicate to the operator which direction, clockwise or anti-clockwise, to rotate the core sample. One color of indicator can be used to indicate clockwise rotation and another color can be used to indicate anticlockwise rotation is required. This is carried out until the core sample is oriented with its lower section at the lower end of the tube. The core sample is then marked for correct orientation and then used for analysis.

In one aspect, it is contemplated that the visual and/or audible orientation indicators, under certain site and/or environmental conditions, may not be sufficiently visible or audible. Thus, an additional or alternative means and/or method may be utilized to ensure that the core sample has been correctly oriented. In this embodiment, the exterior surface 61 of the body of the core barrel head assembly 30 can have angular degree marks that optionally are scribed/etched, machined, molded or otherwise provided, such as by printing or painting, on the exterior surface 61. For example, dashes can be equally spaced around the outside parameter represent one or more angular degrees of the full circle or perimeter. Further scribing of a number every five dashes starting with the number 0 then 5, 10, 15 etc. until 355.

When the core is retrieved and the communication means of the core barrel head assembly communicates with the hand held communicator 400, additional information can be transmitted from the core barrel head assembly to the communicator 400, such as a number between zero 0 and 359 (inclusive) denoting an angular degree of rotation of core barrel head assembly and the core sample. When the core is oriented during one or more embodiments of the method of the present invention, the numerical scribing the core barrel head assembly should be the same as the number transmitted, to the communicator 400, which re-confirms correct orientation. Thus, if the visual or audible means for indicating core orientation are not useful or available, then the core can be oriented using the angular degree arrangement to match the transmitted number, and then can be audited using the communicator 400.

Embodiments of the present invention provide the advantage of a fully operating down hole core barrel head assembly without having to disconnect or disassemble any part of the tool/device from the inner tube and/or from the head assembly or any other part of the drilling assembly that the core barrel head assembly would need to be assembled within for its normal operation. Disconnecting or disassembling the core barrel head assembly from the head assembly and/or inner tube risks failure of seals at those connections and/or risks cross threading of the joining thread. Also, because those sections are threaded together with high force, it takes substantial manual force and large equipment to separate the sections. High surrounding pressure in the drill hole means that the connecting seals between sections function to prevent water and dirt from ingressing into and damaging the device.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A core barrel head assembly having an exterior surface and comprising:

a first interior cavity;

a selectively sealed interior cavity spaced distally from the first interior cavity and having a closed proximal end;

a threaded proximal end portion for coupling to a wire line retrieval portion of a head assembly;

a base portion, wherein the first interior cavity extends distally from the threaded proximal end portion to the base portion;

a window that extends from the exterior surface into optical communication with the sealed interior cavity proximate the closed proximal end of the sealed interior cavity;

at least one electronic instrument that is configured to obtain core orientation data, wherein the at least one electronic instrument comprises at least one digital and/or electro-mechanical sensor in a core orientation data recording tool; and a transmitter configured to transmit core orientation data, wherein the sealed interior cavity is sized and shaped to enclose the at least one electronic instrument.

2. The core barrel head assembly of claim 1, further comprising:

a port positioned proximate the base portion and extending from the exterior surface into fluid communication with the first interior cavity; and a grease fitting mounted in the port to allow for selective passage of grease or other lubricant to and from the exterior surface of the barrel head assembly into communication with the first interior cavity.

3. The core barrel head assembly of claim 1, wherein the sealed interior cavity is sized and shaped to hermetically enclose the transmitter.

4. The core barrel head assembly of claim 1, further comprising an orientation indicator module comprising a light emitter.

5. The core barrel head assembly of claim 4, wherein the core barrel head assembly comprises a plurality of windows that extend from the exterior surface into optical communication with the sealed interior cavity proximate the closed proximal end of the sealed interior cavity, wherein the orientation indicator module is sized and shaped to sealingly close the sealed interior cavity from any intrusion of pressurized fluid into the sealed interior cavity via the plurality of windows.

6. The core barrel head assembly of claim 5, wherein the orientation indicator module is configured to orient or otherwise position the plurality of light emitters so that each light emitter underlies one window.

7. The core barrel head assembly of claim 6, wherein the orientation indicator module further comprises at least one first O-ring seal for preventing any pressurized fluid from entering the sealed interior cavity from the plurality of windows, wherein the at least one first O-ring seal is mounted on an exterior portion of the orientation indicator module and is configured to seal between an exterior portion of the orientation indicator module and a portion of an interior surface of the sealed interior cavity.

8. The core barrel head assembly of claim 6, further comprising a check valve assembly configured to affect a hermetical seal of the sealed interior cavity and to provide fluid control for wire line operation.

9. The core barrel head assembly of claim 8, wherein the check valve assembly comprises a coupled proximal end assembly and a distally tapered seat that defines an interior chamber for operative receipt of a check ball.

10. The core barrel head assembly of claim 9, further comprising a distal end portion, wherein the proximal end assembly of the check valve assembly defines a female threaded coupling that is configured to be threadably coupled to male threads defined on an exterior surface of the distal end portion of the core barrel head assembly.

11. The core barrel head assembly of claim 9, wherein the interior chamber of the check valve assembly extends to a distal end of the check valve assembly, and wherein the check valve assembly further defines at least one port that extends from an exterior surface of the check valve assembly and is in fluid communication with the interior chamber of the check valve assembly.

12. The core barrel head assembly of claim 11, wherein the interior chamber has a distally tapered seat that is adapted to selectively receive the check ball that is sized to selectively block the distally tapered seat.

13. The core barrel head assembly of claim 12, wherein the interior chamber is sized and shaped to allow the check ball to selectively move axially between an open position, in which the check ball is spaced proximally away from the surface of the tapered seat so that pressurized fluid can move through the distal end of the check valve assembly and subsequently through the interior chamber to exit out of the at least one port, and a closed position, in which the check ball is pressurized against the surface of the tapered seat so that pressurized fluid cannot move through the check valve assembly.

14. The core barrel head assembly of claim 4, wherein the light emitter underlies the window, and wherein following retrieval of the core barrel head assembly from down a borehole, the light emitter is configured to provide a visual indication that a desired rotational orientation of the core barrel head assembly has been achieved.

15. The core barrel head assembly of claim 14, wherein the light emitter is further configured to provide a visual indication that further rotation of the core barrel head assembly is required to reach the desired rotational orientation.

16. The core barrel head assembly of claim 1, further comprising an open and threaded distal end portion, wherein the sealed interior cavity extends distally to the open and threaded distal end portion of the core barrel head assembly.

17. The core barrel head assembly of claim 16, further comprising a seal coupler that is configured to be sealingly received in the open threaded distal end portion of the core barrel head assembly.

18. The core barrel head assembly of claim 17, further comprising at least one second O-ring seal for preventing any pressurized fluid from entering the sealed interior cavity, wherein the at least one second O-ring seal is mounted on a portion of the seal coupler and is configured to seal between a portion of the seal coupler and a portion of an interior surface of the open and threaded distal end portion of the core barrel head assembly.

19. The core barrel head assembly of claim 1, wherein the exterior surface defines a plurality of female planar stops.

20. The core barrel head assembly of claim 1, wherein the at least one electronic instrument is programmed to obtain orientation data when the at least one electronic instrument senses no relative movement of the at least one electronic instrument.

21. The core barrel head assembly of claim 20, wherein the at least one electronic instrument is programmed to obtain orientation data when the at least one electronic instrument senses no vibrations, and wherein the at least one electronic instrument is programmed to not obtain orientation data when the at least one electronic instrument determines that the core barrel head assembly is in motion while descending down or ascending up the hole and during drilling.

22. The core barrel head assembly of claim 1, wherein the at least one electronic instrument is programmed to obtain orientation data based on a predetermined time interval scheme.

23. The core barrel head assembly of claim 1, wherein the at least one electronic instrument is configured to obtain orientation data at random periods of time.

24. The core barrel head assembly of claim 1, wherein the at least one electronic instrument is programmed to:

record orientation data relating to an orientation of the at least electronic instrument in a borehole; and receive an interrogation command from an external communication device.

25. The core barrel head assembly of claim 1, wherein the transmitter is configured to transmit core orientation data to a remote device through the window.

* * * * *